US005873146A

United States Patent [19]

Mungo et al.

[11] Patent Number: 5,873,146

[45] Date of Patent: Feb. 23, 1999

[54] HOLDING DEVICE FOR A DOOR

[76] Inventors: Alma Mungo; W T Mungo, both of 1119 E. 88th St., Brooklyn, N.Y. 11236-4761

[21] Appl. No.: 770,342

[22] Filed: Dec. 20, 1996

[51] Int. Cl.[6] ..... E05F 5/02

[52] U.S. Cl. ..... 16/82; 16/374; 292/288

[58] Field of Search ..... 16/82, 319, 374, 16/375, 349, 86 R; 292/288, 289, DIG. 17

[56] References Cited

U.S. PATENT DOCUMENTS

| | | | |
|---|---|---|---|
| 83,967 | 11/1868 | Howell | 16/223 |
| 314,105 | 3/1885 | Carnes | 16/82 |
| 3,786,533 | 1/1974 | O'Donnell | 16/82 |
| 3,918,121 | 11/1975 | Williams | 16/82 |
| 5,027,471 | 7/1991 | Barnes | 16/82 |
| 5,098,142 | 3/1992 | Fontenot | 292/288 |
| 5,288,257 | 2/1994 | Zacherl | 292/DIG. 19 |
| 5,450,652 | 9/1995 | Webb | 16/82 |
| 5,511,837 | 4/1996 | Dempsey | 292/288 |

*Primary Examiner*—Chuck Mah
*Assistant Examiner*—Donald M. Gurley
*Attorney, Agent, or Firm*—Michael I. Kroll

[57] ABSTRACT

A holding device (10) for a door (12) on hinges (14) in a doorway (16) of a room (18) in a building (20) comprising a plate (22). A facility (24) is for mounting the plate (22) over one of the hinges (14) of the door (12). The door (12) will be kept ajar, to allow pets, small children and crawling babies to enter and exit through the doorway (16) in a safe manner. The holding device (10) will also keep a basement door ajar to allow cats freedom to use their litter boxes when needed.

15 Claims, 2 Drawing Sheets

Fig. 3
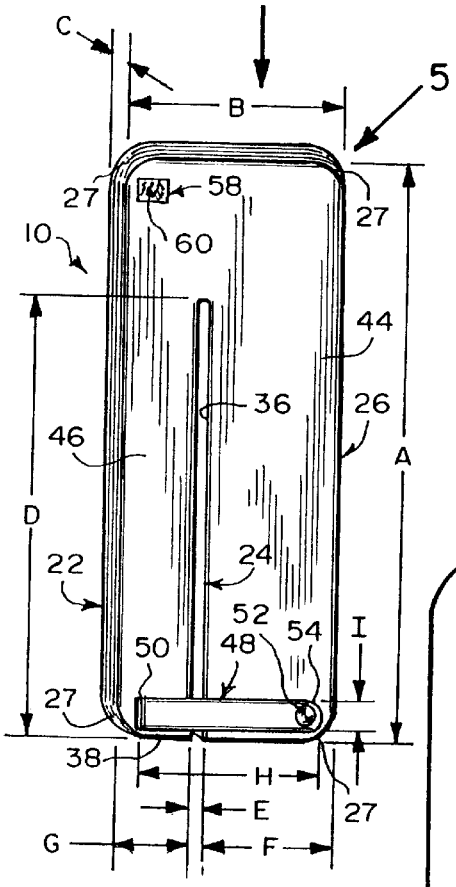
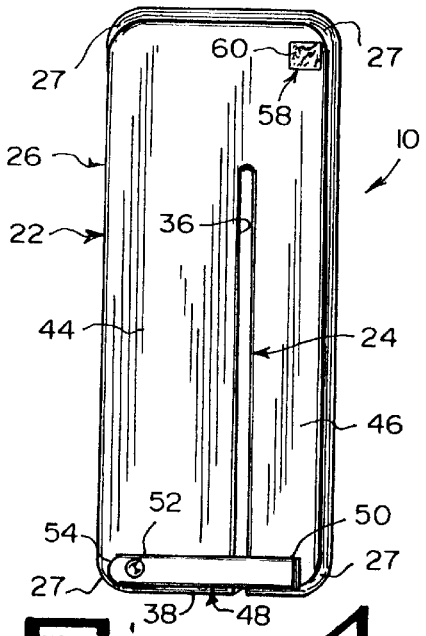
Fig. 4
Fig. 5
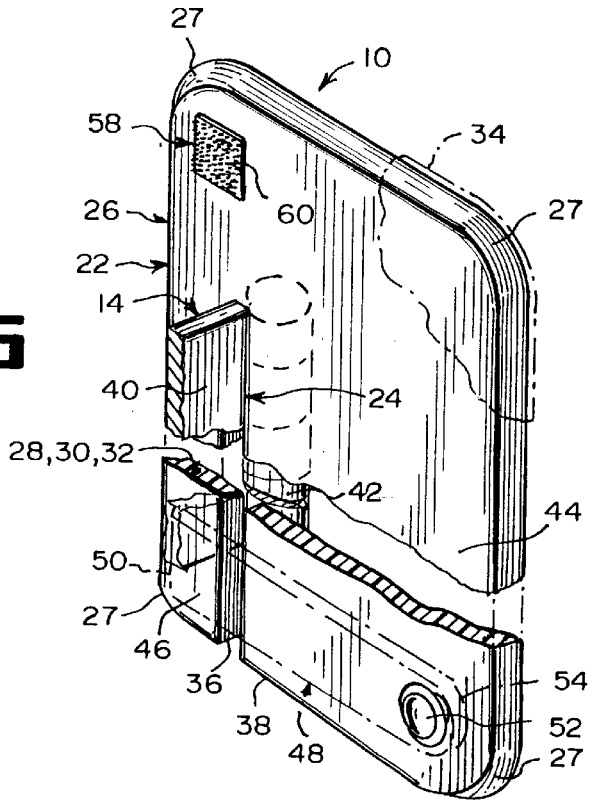

HOLDING DEVICE FOR A DOOR

BACKGROUND OF THE INVENTION

1. Field of the Invention

The instant invention relates generally to doorstops and more specifically it relates to a holding device for a door. The holding device is placed over a door hinge to keep the door opened slightly, to allow pets, small children and crawling babies to enter and exit through the doorway without any problems. Also the door will be ajar slightly to allow fresh air in if desired or for any other reason. The holding device does not make the door stationary. The door is able to be pushed back and forth, but not able to close completely without removing the device first.

2. Description of the Prior Art

Numerous doorstops have been provided in prior art that are wedges inserted beneath doors to hold the doors open at desired positions. While these units may be suitable for the particular purpose to which they address, they would not be as suitable for the purposes of the present invention as heretofore described.

SUMMARY OF THE INVENTION

A primary object of the present invention is to provide a holding device for a door that will overcome the shortcomings of the prior art devices.

Another object is to provide a holding device for a door that is placed over a door hinge to keep the door ajar in a slightly opened position, so as to allow pets, small children and crawling babies to enter and exit the doorway in a safe manner.

An additional object is to provide a holding device for a door that has an optional nice decorative ornament attached especially to cloth covered pasteboard material thereto that will blend in with any occasion or carpet color, so as to enhance the appearance of the room within a building. The holding device that is made out of flexible plastic, polyethylene or similar material would not need to be covered with any other material or enhanced with a decorative ornament. To add these would be optional, because the color and molding of the device made from any of these materials would be attractive enough without the optional add on decorative ornament.

A further object is to provide a holding device for a door that is simple and easy to use.

A still further object is to provide a holding device for a door that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

Various other objects, features and attendant advantages of the present invention will become more fully appreciated as the same becomes better understood when considered in conjunction with the accompanying drawings, in which like reference characters designate the same or similar parts throughout the several views, and wherein;

FIG. 3 is a further enlarged perspective view of the first embodiment with the decorative ornament removed.

FIG. 4 is a perspective view of a second embodiment of the instant invention that can be installed on a hinge of a left handed door.

FIG. 5 is a still further enlarged perspective view of the first embodiment taken in the direction of arrow 5 in FIG. 3, with parts broken away and in phantom, showing how the first embodiment is installed on the hinge.

Similar reference characters denote corresponding features consistently throughout the attached drawings.

DETAILED DESCRIPTION OF THE PREFERRED EMBODIMENTS

Figure 1:
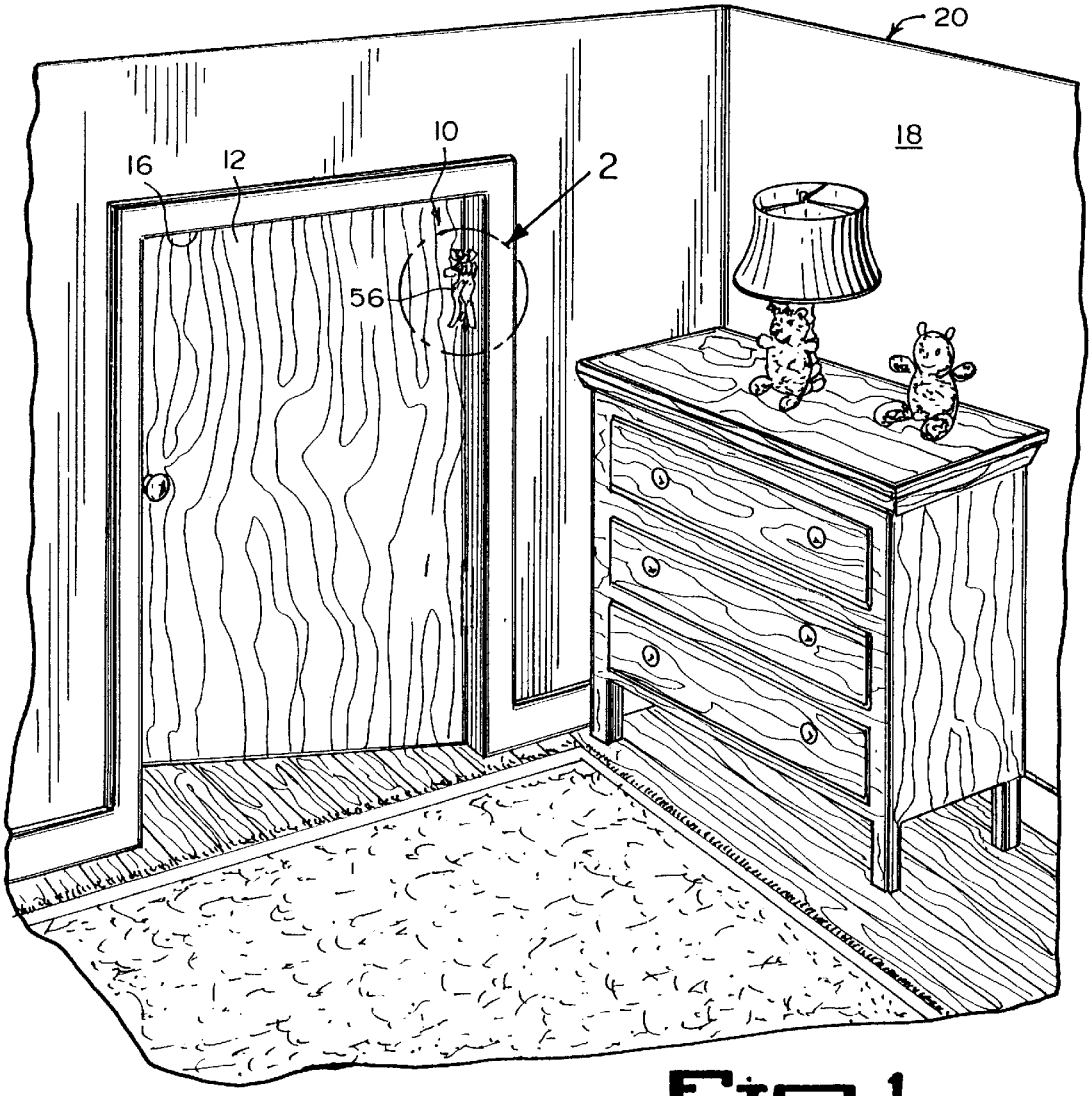
FIG. 1 is a perspective view of a portion of a room in a building, showing a first embodiment of the instant invention installed on a hinge of a right handed door.

Turning now descriptively to the drawings, in which similar reference characters denote similar elements throughout the several views, FIGS. 1 through 5 illustrate a holding device 10 for a door 12 on hinges 14 in a doorway 16 of a room 18 in a building 20 comprising a plate 22. A facility 24 is for mounting the plate 22 over one of the hinges 14 of the door 12. The door 12 will be kept ajar, to allow pets, small children and crawling babies to enter and exit through the doorway 16 in a safe manner.

The plate 22 is a slightly flexible flat rectangular member 26. Plate 22 includes four rounded corners 27 to prevent anyone, especially small children from getting hurt. The plate 22 can be fabricated out of a colorful plastic material 28, out of a colorful polyethylene material 30 or similar material or out of a pasteboard material 32. Also, the plate 22 can be covered with an optional non-bulky colorful cloth-like material 34, as shown in phantom in FIG. 5. If the right material is used and molded correctly, then only the device 10 made of pasteboard material 32 would have to be covered with the non-bulky colorful cloth-like material 34. The ones made out of plastic material 28 or polyethylene material 30 should be made of different color choices.

The mounting facility 24 is a longitudinal slot 36 extending inwardly from one end 38 of the plate 22. The plate 22 can slip over the door hinge 14 between one leaf 40 and the barrels 42 of the door hinge 14, as best seen in FIG. 5. The longitudinal slot 36 is offset to one side thereof, so as to separate the plate 22 into a wide segment 44 and a narrow segment 46. The wide segment 44 will bear against the side of the doorway 16, to keep the door 12 ajar.

A strap 48 is affixed at a first end 50 to the plate 22. The strap 48 will extend across the longitudinal slot 36 adjacent the one end 38 of the plate 22. A snap fastener 52 or similar fastener is between a second end 54 of the strap 48 and the plate 22. The strap 48 will be retained beneath the leaf 40 of the door hinge 14, to prevent children from easily removing the plate 22, if placed on a lower hinge 14. If the plate 22 is made of colorful plastic material 28, colorful polyethylene material 30 or similar material, the strap 48 should then be welded or mated onto the material and fastened with the appropriate fastener.

Figure 2:
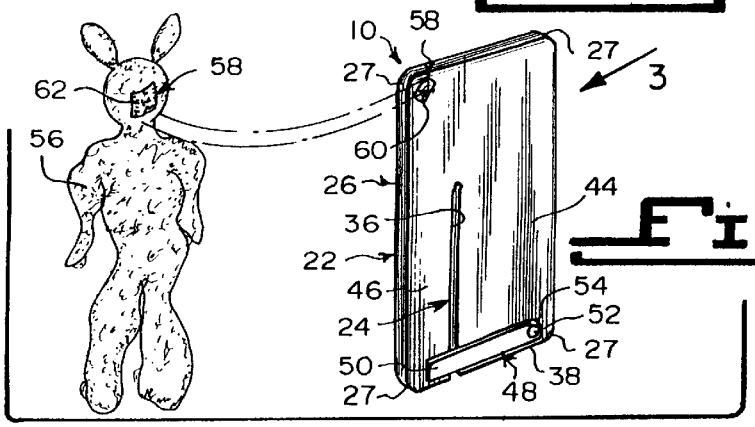
FIG. 2 is an enlarged exploded perspective view of the first embodiment per se as indicated by arrow 2 in FIG. 1.

The holding device 10 can further contain an optional decorative ornament 56, as shown in FIGS. 1 and 2. A structure 58 is for attaching the optional decorative ornament 56 to the plate 22, so as to enhance the appearance thereof. The optional decorative ornament 56 would be better attached to the edge thickness or centered at the top on the narrow segment 46 for doors 12 opened with a left hand in pulling the door 12 inside the room 18. When opened from a hall within an apartment or house with a right hand, the optional decorative ornament 56 could be placed on the narrow segment 46.

The removable attaching structure 58 is a pair of hook and loop fabric fastener tabs 60, 62. One tab 60 is affixed to the plate 22, while the other tab 62 is affixed to the optional decorative ornament 56. The tabs 60, 62 are pressed and mated together. The optional decorative ornament 56 will be attached to the plate 22. The optional decorative ornament 56 can also be permanently sewn onto the plate 22.

Typical sizes of the holding device 10, but not limited thereto are:

A) Length of plate 12 is six inches.
B) Width of plate 12 is two and a quarter inches.
C) Thickness of plate 12 is between one eighth to one quarter of an inch.
D) Length of longitudinal slot is four and one half inches.
E) Width of longitudinal slot is one eighth of an inch.
F) Width of wide segment 44 is one and three eights inches.
G) Width of narrow segment 46 is three quarters of an inch.
H) Length of strap 48 is two inches.
I) Width of strap 48 is five eighths of an inch.

LIST OF REFERENCE NUMBERS

| | |
|---|---|
| 10 | holding device |
| 12 | door |
| 14 | hinge of 12 |
| 16 | doorway in 18 |
| 18 | room of 20 |
| 20 | building |
| 22 | plate of 10 |
| 24 | mounting facility of 10 |
| 26 | slightly flexible flat rectangular member for 22 |
| 27 | rounded corner of 22 |
| 28 | plastic material for 22 |
| 30 | polyethylene material for 22 |
| 32 | pasteboard material for 22 |
| 34 | non-bulky colorful cloth-like material on 22 |
| 36 | longitudinal slot in 22 for 24 |
| 38 | one end of 22 |
| 40 | leaf of 14 |
| 42 | barrel of 14 |
| 44 | wide segment of 22 |
| 46 | narrow segment of 22 |
| 48 | strap on 22 |
| 50 | first end of 48 |
| 52 | snap fastener between 54 and 22 |
| 54 | second end of 48 |
| 56 | optional decorative ornament of 10 |
| 58 | attaching structure of 10 |
| 60 | hook fabric fastener tab of 58 |
| 62 | loop fabric fastener tab of 58 |

It will be understood that each of the elements described above, or two or more together may also find a useful application in other types of methods differing from the type described above.

While certain novel features of this invention have been shown and described are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A holding device for a door on hinges in a doorway of a room in a building comprising:

a) a plate; and b) means for mounting said plate over one of the hinges of the door, so that the door will be kept ajar, to allow pets, small children and crawling babies to enter and exit through the doorway in a safe manner, wherein said mounting means is a longitudinal slot extending inwardly from one end of said plate, so that said plate can slip over the door hinge between one leaf and the barrels of the door hinge, said holding device further including:

i) a strap affixed at a first end to said plate, so that said strap will extend across said longitudinal slot adjacent the one end of said plate; and ii) a snap fastener between a second end of said strap and said plate, so that said strap will be retained beneath the leaf of the door hinge, to prevent children from easily removing said plate, if placed on a lower hinge.

2. A holding device for a door as recited in claim 1, wherein said plate is a slightly flexible flat rectangular member.

3. A holding device for a door as recited in claim 1, wherein said plate is fabricated out of a colorful plastic material.

4. A holding device for a door as recited in claim 1, wherein said plate is fabricated out of a colorful polyethylene material.

5. A holding device for a door as recited in claim 1, wherein said plate is fabricated out of a pasteboard material.

6. A holding device for a door as recited in claim 1, wherein said plate is covered with a non-bulky colorful cloth-like material, especially to cover a pasteboard material.

7. A holding device for a door as recited in claim 1, wherein said longitudinal slot is offset to one side thereof, so as to separate said plate into a wide segment and a narrow segment, so that said wide segment will bear against the side of the doorway to keep the door ajar.

8. A holding device for a door as recited in claim 1, further including:

a) an optional decorative ornament; and b) means for attaching said optional decorative ornament to said plate, so as to enhance the appearance thereof.

9. A holding device for a door as recited in claim 8, wherein said attaching means is a pair of hook and loop fabric fastener tabs, in which one said tab is affixed to said plate, while other said tab is affixed to said optional decorative ornament, so that when said tabs are pressed and mated together, said optional decorative ornament will be attached to said plate.

10. A holding device for a door as recited in claim 1, wherein said plate includes four rounded corners to prevent anyone, especially small children from getting hurt.

11. A holding device for a door as recited in claim 10, wherein said plate is fabricated out of a colorful plastic material.

12. A holding device for a door as recited in claim 10, wherein said plate is fabricated out of a colorful polyethylene material.

13. A holding device for a door as recited in claim 10, wherein said plate is fabricated out of a pasteboard material.

14. A holding device for a door as recited in claim 10, wherein said plate is covered with a non-bulky colorful cloth-like material, especially to cover a pasteboard material.

15. A holding device for a door as recited in claim 10, wherein said longitudinal slot is offset to one side thereof, so as to separate said plate into a wide segment and a narrow segment, so that said wide segment will bear against the side of the doorway to keep the door ajar.

* * * * *